US009847048B2

(12) United States Patent
Choi et al.

(10) Patent No.: US 9,847,048 B2
(45) Date of Patent: Dec. 19, 2017

(54) APPARATUS AND METHOD FOR DRIVING E-PAPER DISPLAY

(71) Applicant: Solomon Systech Limited, Hong Kong (HK)

(72) Inventors: Wai Sum Choi, Hong Kong (HK); Jian Han, Hong Kong (HK)

(73) Assignee: Solomon Systech Limited, Hong Kong (HK)

( * ) Notice: Subject to any disclaimer, the term of this patent is extended or adjusted under 35 U.S.C. 154(b) by 196 days.

(21) Appl. No.: 14/952,936

(22) Filed: Nov. 26, 2015

(65) Prior Publication Data

US 2017/0148364 A1 May 25, 2017

(30) Foreign Application Priority Data

Nov. 20, 2015 (CN) ..... 2015 1 0810624

(51) Int. Cl.
*G09G 3/04* (2006.01)
*G09G 3/34* (2006.01)

(52) U.S. Cl.
CPC ..... *G09G 3/04* (2013.01); *G09G 3/344* (2013.01); *G09G 2300/0486* (2013.01); *G09G 2310/0297* (2013.01); *G09G 2310/06* (2013.01); *G09G 2310/08* (2013.01)

(58) Field of Classification Search
CPC ..... G09G 2310/0297; G09G 2310/06; G09G 2310/08; G09G 3/344; G09G 3/04; G09G 2300/0486
USPC ..... 345/33, 34, 107
See application file for complete search history.

(56) References Cited

U.S. PATENT DOCUMENTS

| | | | | |
|---|---|---|---|---|
| 7,773,069 | B2 | 8/2010 | Miyasaka et al. | |
| 2005/0134530 | A1 | 6/2005 | Khurana et al. | |
| 2007/0070032 | A1* | 3/2007 | Chung | G09G 3/344 345/107 |
| 2007/0171187 | A1 | 7/2007 | Saito | |
| 2008/0238894 | A1* | 10/2008 | Ng | G09G 3/04 345/204 |
| 2008/0259065 | A1* | 10/2008 | Wright | H03K 19/00369 345/205 |
| 2008/0266301 | A1* | 10/2008 | Vergnes | G06F 3/147 345/506 |
| 2010/0103157 | A1* | 4/2010 | Goto | G09G 3/3614 345/211 |

(Continued)

*Primary Examiner* — Yuzhen Shen

(57) ABSTRACT

An apparatus for driving an e-paper display is provided. The display includes a plurality of segments. The apparatus includes: a memory module for each segment; a SEG 4-to-1 multiplexor connected with the memory module for each segment; a 2-to-1 multiplexor connected with the SEG 4-to-1 multiplexor for each segment; a SEG waveform generator connected with the SEG 4-to-1 multiplexor; a COM waveform generator connected with the 2-to-1 multiplexor; a SEG waveform table connected with the SEG waveform generator; and a COM waveform table connected with the COM waveform generator. The memory module for each segment includes an old Data corresponding to a current state of the segment of the display, a new Data corresponding to a new state to be driven for the segment in a display update period, and a COM_Option memory corresponding to an option state. A method for driving an e-paper display is also provided.

20 Claims, 5 Drawing Sheets

(56) References Cited

U.S. PATENT DOCUMENTS

| | | | | |
|---|---|---|---|---|
| 2010/0245322 | A1* | 9/2010 | Nakanishi | G09G 3/3688 345/211 |
| 2010/0328286 | A1* | 12/2010 | Piasecki | G06F 3/0412 345/211 |
| 2012/0026153 | A1* | 2/2012 | Katagiri | G09G 3/18 345/212 |
| 2012/0050242 | A1* | 3/2012 | Hashimoto | G09G 3/344 345/208 |

* cited by examiner

| | Iteration 1 | Iteration 2 |
|---|---|---|
| Step 201 | • Start with all white segments ( greyscale level GS0 ) 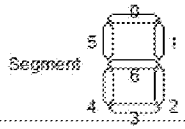  | |
| Step 203 | • Select greyscale GS1 for this iteration | • Select greyscale GS2, GS3 for this iteration |
| Step 205 | • Segment 1 and Segment 2 are to be driven to GS1 | • Segment 4,5,6 are to be driven GS2,GS2,GS3 |

| Segment | 0 | 1 | 2 | 3 | 4 | 5 | 6 |
|---|---|---|---|---|---|---|---|
| Old Data | 0 | 0 | 0 | 0 | 0 | 0 | 0 |
| New Data | 0 | 1 | 1 | 0 | 0 | 0 | 0 |
| COM Option | E | D | D | E | E | E | E |

| Old / New Data | 0 / 0 | 0 / 1 | 1 / 0 | 1 / 1 |
|---|---|---|---|---|
| Waveform Target | X | From GS0 to GS1 | X | X |

X = Don't Care E = Enable. D= Disable

| Segment | 0 | 1 | 2 | 3 | 4 | 5 | 6 |
|---|---|---|---|---|---|---|---|
| Old Data | 0 | 1 | 1 | 0 | 0 | 0 | 0 |
| New Data | X | X | X | X | 0 | 0 | 1 |
| COM Option | E | E | E | E | D | D | D |

| Old / New Data | 0 / 0 | 0 / 1 | 1 / 0 | 1 / 1 |
|---|---|---|---|---|
| Waveform Table Target | From GS0 to GS2 | From GS0 to GS3 | X | X |

• X = Don't Care. E = Enable. D= Disable

| | | |
|---|---|---|
| Step 207 | • Drive the display panel | • Drive the display panel |
| Step 209 | • Display image updated 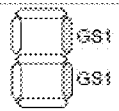  | • Display image updated 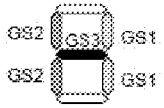  |
| Step 211 | • Start another iteration to drive other segments. | • No more segments to be driven |
| Step 213 | | • END |

FIG. 3

APPARATUS AND METHOD FOR DRIVING E-PAPER DISPLAY

CROSS-REFERENCE TO RELATED APPLICATIONS

The present patent application claims the benefit of Chinese Patent Application No. 201510810624.4, filed on Nov. 20, 2015, the contents of which are hereby incorporated by reference.

FIELD OF THE PATENT APPLICATION

The present patent application generally relates to electronic display devices and more specifically to an apparatus and a method for driving an e-paper display.

BACKGROUND

Conventional greyscale display drivers have multiple bits of Display RAM per display segment according to number of greyscale. For example, 2 bits per segment for 4 greyscale levels, 3 bits per segment for 8 greyscale levels. On the other hand, to drive a monochrome (2-level) e-paper display, 4 different driving waveforms are utilized to drive each segment (black or white), which are: from white to white, from white to black, from black to white, and from black to black. The Display Data RAM has 2 bits per segment. Typical segment type e-paper display drivers do not support greyscale displays.

In addition, to drive an e-paper display panel, costly double layer flex connectors are typically required when the display panel and the driver IC pin assignment do not match. Retooling the display panel or the driver IC is another costly solution.

SUMMARY

The present patent application is directed to an apparatus for driving an e-paper display. In one aspect, the display includes a plurality of segments, the apparatus including: a timing controller; a memory module connected with the timing controller for each segment; a SEG 4-to-1 multiplexor connected with the memory module for each segment; a 2-to-1 multiplexor connected with the SEG 4-to-1 multiplexor for each segment; a SEG cell connected with the 2-to-1 multiplexor for each segment; a SEG waveform generator connected with the timing controller and the SEG 4-to-1 multiplexor; a COM waveform generator connected with the timing controller and the 2-to-1 multiplexor; a COM cell connected with the COM waveform generator; a SEG waveform table connected with the SEG waveform generator; and a COM waveform table connected with the COM waveform generator. The memory module for each segment includes an old Data corresponding to a current state of the segment of the display, a new Data corresponding to a new state to be driven for the segment in a display update period, and a COM_Option memory corresponding to an option state. Based on the current state and the new state, the SEG 4-to-1 multiplexor is configured to select one waveform from output of the SEG waveform generator and output the selected waveform to the 2-to-1 multiplexor. Based on the option state, the 2-to-1 multiplexor is configured to select a waveform from output of the COM waveform generator and output of the SEG 4-to-1 multiplexor and output the selected waveform to the SEG cell.

The timing controller may be configured to output timing signals during display update to the SEG waveform generator, the COM waveform generator, and the memory module. The SEG waveform table and the COM waveform table may be respectively configured to store and output static parameters of SEG waveforms and COM waveforms. The SEG waveform generator may be configured to generate and output four SEG waveforms in digital domain according to waveform parameters and timing signals.

The COM waveform generator may be configured to generate and output COM waveforms in digital domain. The SEG cells and the COM cell may be respectively configured to output analog SEG and COM driving signals to drive the display.

In another aspect, the present patent application provides a method for driving an e-paper display. The display includes a plurality of segments. The method includes: starting with the display with an image of all segments of known greyscale levels; selecting greyscale levels from the image for an iteration of driving the display; identifying segments of the selected greyscale levels; setting a memory module for all segments; setting a SEG waveform table and a COM waveform table to define driving waveforms; driving the display panel with the defined driving waveforms; displaying image updated with the identified segments in the selected greyscale levels; and starting another iteration if there are segments that need to be driven to alter greyscale level. The SEG waveform table is connected with a SEG waveform generator, which is further connected with a SEG 4-to-1 multiplexor for each identified segment. The COM waveform table is connected with a COM waveform generator, which is further connected with 2-to-1 multiplexor for each identified segment. The 2-to-1 multiplexor is connected with the SEG 4-to-1 multiplexor for each identified segment. The memory module for each identified segment includes an old Data corresponding to a current state of the segment of the display, a new Data corresponding to a new state to be driven for the segment in a display update period, and a COM_Option memory corresponding to an option state. Based on the current state and the new state, the SEG 4-to-1 multiplexor is configured to select one waveform from output of the SEG waveform generator and output the selected waveform to the 2-to-1 multiplexor. Based on the option state, the 2-to-1 multiplexor is configured to select a waveform from output of the COM waveform generator and output of the SEG 4-to-1 multiplexor and output the selected waveform. The method further includes setting the option state so that the 2-to-1 multiplexor is configured to select output of the SEG 4-to-1 multiplexor for the identified segments; and setting the option state so that the 2-to-1 multiplexor is configured to select output of the COM waveform generator for segments other than the identified segments.

The method may further include outputting timing signals during display update to the SEG waveform generator, the COM waveform generator, and the memory module with a timing controller. The SEG waveform table and the COM waveform table may be respectively configured to store and output static parameters of SEG waveforms and COM waveforms. The SEG waveform generator may be configured to generate and output four SEG waveforms in digital domain according to waveform parameters and timing signals.

The COM waveform generator may be configured to generate and output COM waveforms in digital domain. The method may further include outputting analog SEG and COM driving signals to drive the display with a SEG cell for each segment and a COM cell respectively.

In yet another aspect, the present patent application provides an apparatus for driving an e-paper display, the display including a plurality of segments, the apparatus including: a memory module for each segment; a SEG 4-to-1 multiplexor connected with the memory module for each segment; a 2-to-1 multiplexor connected with the SEG 4-to-1 multiplexor for each segment; a SEG waveform generator connected with the SEG 4-to-1 multiplexor; a COM waveform generator connected with the 2-to-1 multiplexor; a SEG waveform table connected with the SEG waveform generator; and a COM waveform table connected with the COM waveform generator. The memory module for each segment includes an old Data corresponding to a current state of the segment of the display, a new Data corresponding to a new state to be driven for the segment in a display update period, and a COM_Option memory corresponding to an option state. Based on the current state and the new state, the SEG 4-to-1 multiplexor is configured to select one waveform from output of the SEG waveform generator and output the selected waveform to the 2-to-1 multiplexor. Based on the option state, the 2-to-1 multiplexor is configured to select a waveform from output of the COM waveform generator and output of the SEG 4-to-1 multiplexor and output the selected waveform to the SEG cell.

The apparatus may further include a timing controller configured to output timing signals during display update to the SEG waveform generator, the COM waveform generator, and the memory module. The SEG waveform table and the COM waveform table may be respectively configured to store and output static parameters of SEG waveforms and COM waveforms.

The SEG waveform generator may be configured to generate and output four SEG waveforms in digital domain according to waveform parameters and timing signals. The COM waveform generator may be configured to generate and output COM waveforms in digital domain. The apparatus may further include a SEG cell connected with the 2-to-1 multiplexor for each segment. The apparatus may further include a COM cell connected with the COM waveform generator. The SEG cells and the COM cell may be respectively configured to output analog SEG and COM driving signals to drive the display.

BRIEF DESCRIPTIONS OF THE DRAWINGS

FIG. 3 is a diagram illustrating 2 iterations of updating a display panel using the method depicted in FIG. 2 in accordance with another embodiment of the present patent application.

DETAILED DESCRIPTION

Reference will now be made in detail to a preferred embodiment of the apparatus and the method for driving an e-paper display disclosed in the present patent application, examples of which are also provided in the following description. Exemplary embodiments of the apparatus and the method for driving an e-paper display disclosed in the present patent application are described in detail, although it will be apparent to those skilled in the relevant art that some features that are not particularly important to an understanding of the apparatus and the method for driving an e-paper display may not be shown for the sake of clarity.

Furthermore, it should be understood that the apparatus and the method for driving an e-paper display disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 1:
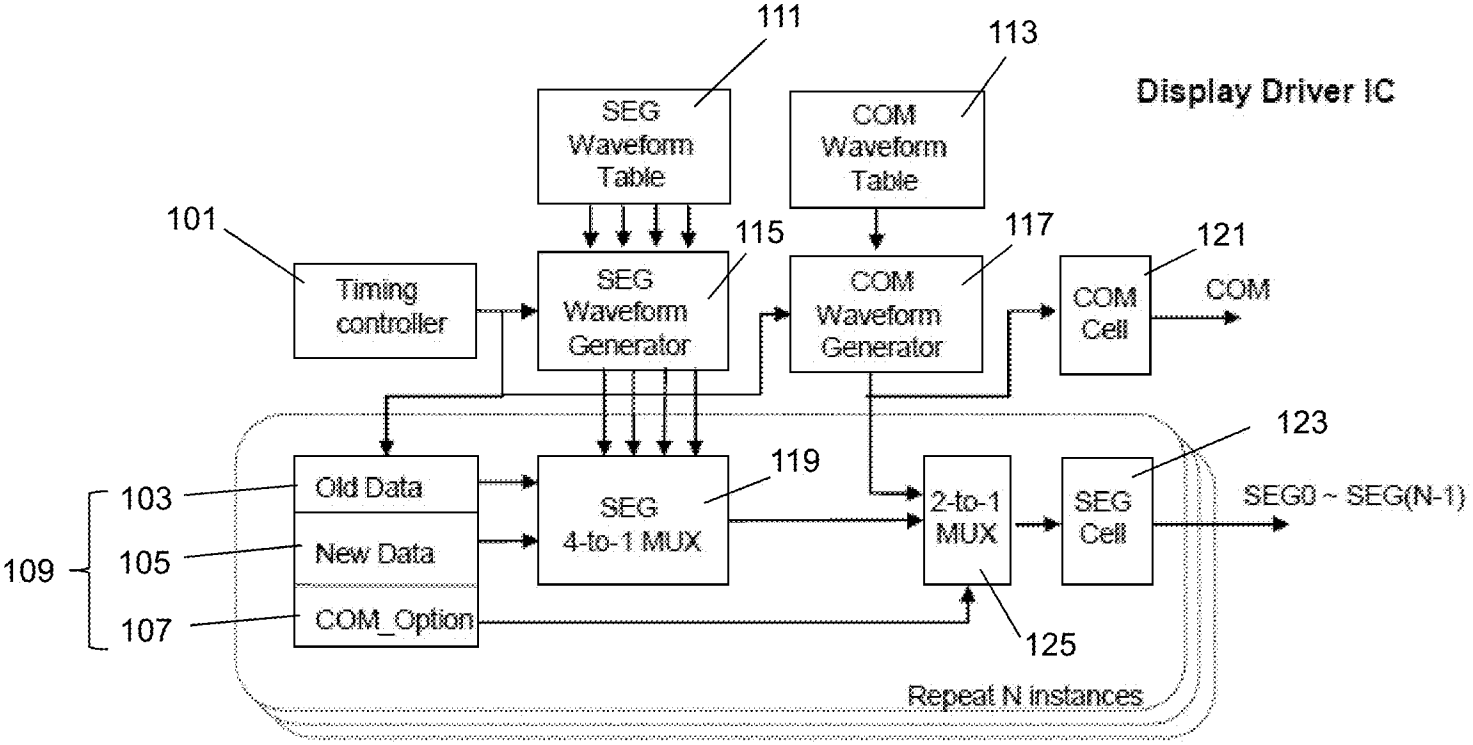
FIG. 1 is a schematic diagram of an apparatus for driving an e-paper display in accordance with an embodiment of the present patent application.

FIG. 1 is a schematic diagram of an apparatus for driving an e-paper display in accordance with an embodiment of the present patent application. Referring to FIG. 1, the apparatus for driving an e-paper display is a display driver IC for driving an e-paper display. The display includes a plurality of segments. The apparatus includes a timing controller 101, a memory module 109 (also referred to as the Display RAM or the Display Data RAM) connected with the timing controller 101 for each segment, a SEG 4-to-1 multiplexor 119 connected with the memory module 109 for each segment, a 2-to-1 multiplexor 125 connected with the SEG 4-to-1 multiplexor 119 for each segment, a SEG cell 123 connected with the 2-to-1 multiplexor 125 for each segment, a SEG waveform generator 115 connected with the timing controller 101 and the SEG 4-to-1 multiplexor 119, a COM waveform generator 117 connected with the timing controller 101 and the 2-to-1 multiplexor 125, a COM cell 121 connected with the COM waveform generator 117, a SEG waveform table 111 connected with the SEG waveform generator 115, and a COM waveform table 113 connected with the COM waveform generator 117. It is noted that the memory module 109, the SEG 4-to-1 multiplexor 119, the 2-to-1 multiplexor 125, and the SEG cell 123 repeat for each segment of the display. In other words, suppose the display includes N segments, then the apparatus for driving the display includes N instances of the memory module 109, the SEG 4-to-1multiplexor 119, the 2-to-1 multiplexor 125, and the SEG cell 123.

The memory module 109 for each segment, which is the Display Data RAM, includes an old Data 103 corresponding to a current state of the segment of the display, a new Data 105 corresponding to a new state to be driven for the segment in a display update period, and a COM_Option memory 107, which corresponds to an option state and includes a bit for the segment so as to enable the option of driving COM waveform at the corresponding SEG pin.

Based on the current state that the old Data 103 corresponds to and the new state that the new Data 105 corresponds to, the SEG 4-to-1 multiplexor 119 is configured to select one waveform from the output of the SEG waveform generator 115 and output the selected waveform to the 2-to-1 multiplexor 125. Based on the option state that the COM_Option memory 107 corresponds to, the 2-to-1 multiplexor 125 is configured to select a waveform from the output of the COM waveform generator 117 (a COM waveform) and the output of the SEG 4-to-1 multiplexor 119 (a SEG waveform) and output the selected waveform to the SEG cell 123.

In this embodiment, the timing controller 101 is configured to output timing signals during display update, to SEG and COM waveform generators 115 and 117, and to display data RAM (i.e. the memory module 109). The SEG and COM waveform tables 111 and 113 are respectively configured to store and output static parameters of SEG and COM waveforms. The SEG waveform generator 115 is configured to generate and output 4 SEG waveforms in digital domain according to waveform parameters and timing signals. The COM waveform generator 117 is configured to generate and output COM waveforms in digital domain accordingly. The SEG cells 123 and the COM cell 121 are respectively configured to output analog SEG and COM driving signals to drive the display panel.

In this embodiment, the display panel can be driven to display images with multiple greyscale levels. For segments with COM_Option enabled, the corresponding SEG pins output the COM waveform and thus the greyscale levels of the segments can be retained in the subsequent display updates. Due to this property, displaying an image of multiple greyscale levels can be achieved by multiple display updates. For each of these display updates, selected segments can be driven to different greyscale levels arbitrarily by setting the waveform tables, while the greyscale levels of other segments are not affected.

Figure 2:
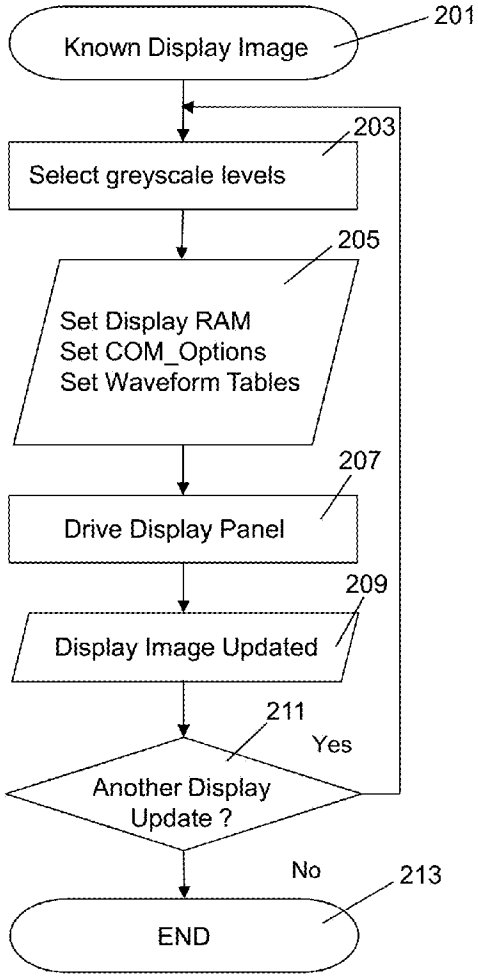
FIG. 2 is a flow chart illustrating a method for driving an e-paper display in accordance with another embodiment of the present patent application.

FIG. 2 is a flow chart illustrating a method for driving an e-paper display in accordance with another embodiment of the present patent application. Referring to FIG. 2, the method can be used to drive an e-paper display to display a greyscale image and the method includes the following steps:

Step 201: starting with the display panel with a known image, usually a clear image of all white segments;

Step 203: selecting greyscale levels from the image for this iteration of driving the display panel;

Step 205: identifying segments of the selected greyscale levels; accordingly, setting the corresponding Display RAM bits (i.e. the memory module 109) of these segments, and disabling their COM_Option; for other segments, enabling their COM_Option so that their greyscale levels are maintained; setting the waveform tables to define the driving waveforms which are able to drive the segments to the selected greyscale levels;

Step 207: driving the display panel with the defined driving waveforms;

Step 209: displaying the image updated with the identified segments in the selected greyscale levels;

Step 211: starting another iteration if there are segments that need to be driven to alter the greyscale level; and Step 213: ending with the image of segments in desired greyscale levels.

FIG. 3 is a diagram illustrating 2 iterations of updating a display panel using the method depicted in FIG. 2 in accordance with another embodiment of the present patent application. Referring to FIG. 3, in iteration 1, the method includes: starting with all white segments (greyscale level GS0) (step 201); selecting greyscale GS1 for this iteration (step 203); identifying segments (segment 1, segment 2) of the selected greyscale levels, setting the corresponding Display RAM bits of these segments, and disabling their COM_Option, while for other segments, enabling their COM_Option, and setting the waveform tables to define the driving waveforms (step 205); driving the display panel (step 207); displaying the image updated (step 209); and starting another iteration to drive other segments (step 211).

In iteration 2, referring to FIG. 3, the method includes: select greyscale GS2, GS3 for this iteration (step 203); identifying segments of the selected greyscale levels, setting the corresponding Display RAM bits of these segments (segment 4, segment 5, segment 6), and disabling their COM_Option, while for other segments, enabling their COM_Option, and setting the waveform tables to define the driving waveforms (step 205); driving the display panel (step 207); displaying the image updated (step 209); and identifying that no more segments are to be driven (step 211).

Figure 4:
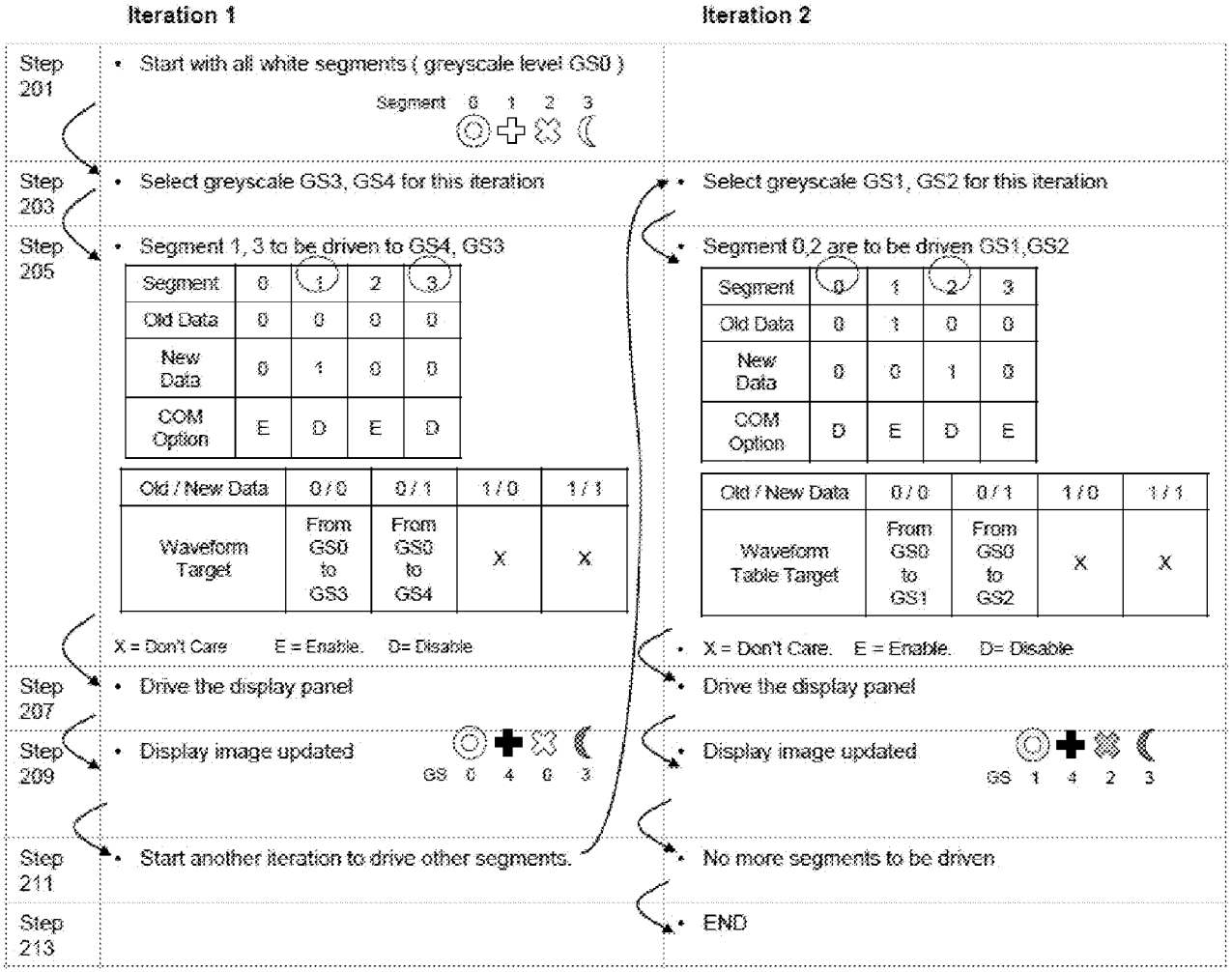
FIG. 4 is a diagram illustrating 2 iterations of updating a display panel using the method depicted in FIG. 2 in accordance with yet another embodiment of the present patent application.

FIG. 4 is a diagram illustrating 2 iterations of updating a display panel using the method depicted in FIG. 2 in accordance with yet another embodiment of the present patent application. Referring to FIG. 4, in iteration 1, the method includes: starting with all white segments (greyscale level GS0) (step 201); selecting greyscale GS3, GS4 for this iteration (step 203); identifying segments (segment 1, segment 3) of the selected greyscale levels, setting the corresponding Display RAM bits of these segments, and disabling their COM_Option, while for other segments, enabling their COM_Option, and setting the waveform tables to define the driving waveforms (step 205); driving the display panel (step 207); displaying the image updated (step 209); and starting another iteration to drive other segments (step 211).

In iteration 2, referring to FIG. 4, the method includes: select greyscale GS1, GS2 for this iteration (step 203); identifying segments (segment 0, segment 2) of the selected greyscale levels, setting the corresponding Display RAM bits of these segments, and disabling their COM_Option, while for other segments, enabling their COM_Option, and setting the waveform tables to define the driving waveforms (step 205); driving the display panel (step 207); displaying the image updated (step 209); and identifying that no more segments are to be driven (step 211).

The apparatus and the method in the above embodiments provide greyscale display capability, with which a monochrome display driver with relatively few additional circuits becomes capable of displaying greyscale image of arbitrary number of greyscale levels, which is not limited by the number of bits of Display RAM per segment inside the driver IC.

In the above embodiments, the COM_Option allows SEG COM pin assignment flexibility. Each SEG pin can be optionally set to drive COM waveforms, to support different panels or PCB routings. Multiple panels being driven by one display driver IC is made possible. The COM_Option supports a wide range of COM output driving strength requirements. COM_Option of a variable number of neighboring SEG pins can be enabled to drive the COM waveform. Connecting them together, with or without another dedicated COM pin, supports a wide range of COM output driving strength requirements. Therefore, retooling panels, flex connectors, and driver ICs can be avoided.

Figure 5:
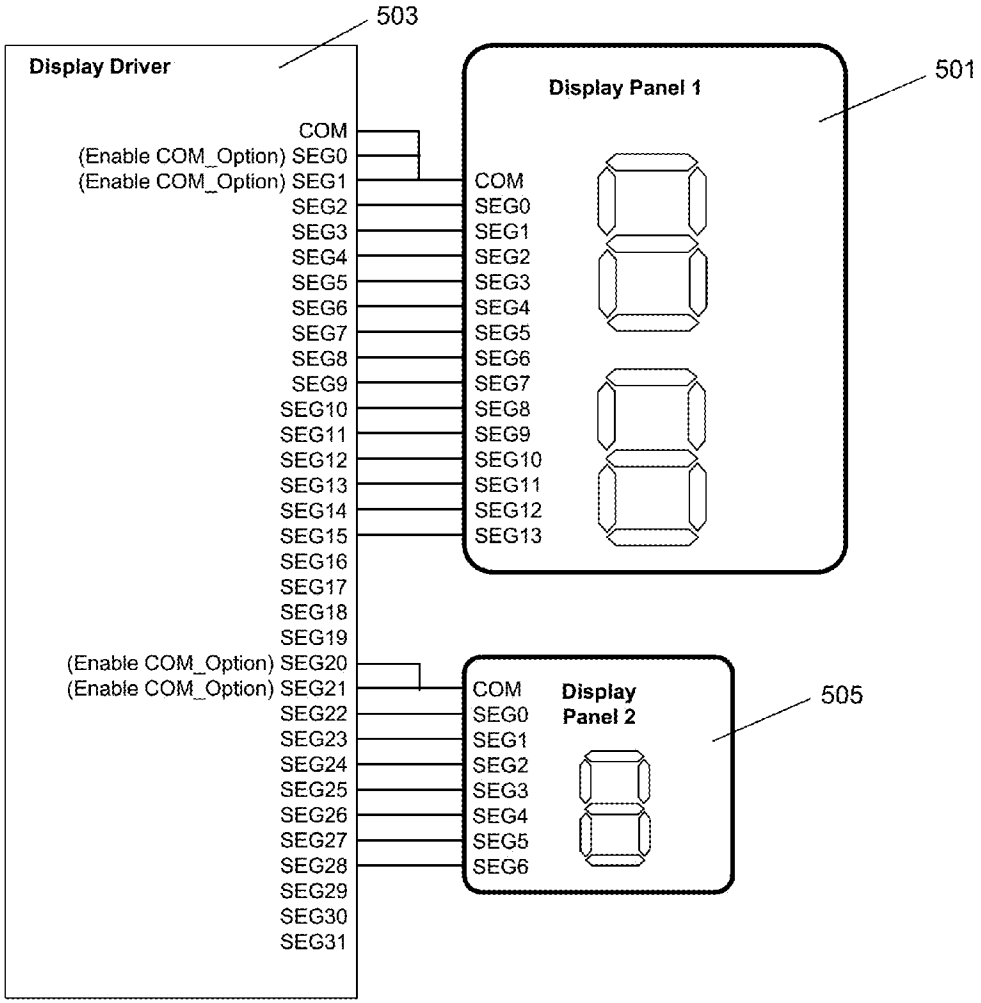
FIG. 5 illustrates two different display panels being driven by the same display driver IC in accordance with another embodiment of the present patent application.

FIG. 5 illustrates two different display panels being driven by the same display driver IC in accordance with another embodiment of the present patent application. Referring to FIG. 5, display Panel 1 (501) has a relatively large size. For the display driver IC 503, the COM_Option of SEG0 and SEG1 is enabled. SEG0, SEG1 and COM are connected so that they provide a relatively strong COM driving signal for the display panel 1 (501). In the meanwhile, COM_Option of SEG20 and SEG21 of the display driver IC 503 is enabled, and SEG20 and SEG21 of the display driver IC 503 are connected to provide a COM driving signal so that display panel 2 (505) is driven by the same display driver IC 503.

While the present patent application has been shown and described with particular references to a number of embodiments thereof, it should be noted that various other changes or modifications may be made without departing from the scope of the present invention.

What is claimed is:

1. An apparatus for driving an e-paper display, the display comprising a plurality of segments, the apparatus comprising:

a timing controller;

a memory module connected with the timing controller for each segment;

a SEG 4-to-1 multiplexor connected with the memory module for each segment;

a 2-to-1 multiplexor connected with the SEG 4-to-1 multiplexor for each segment;

a SEG cell connected with the 2-to-1 multiplexor for each segment;

a SEG waveform generator connected with the timing controller and the SEG 4-to-1 multiplexor;

a COM waveform generator connected with the timing controller and the 2-to-1 multiplexor;

a COM cell connected with the COM waveform generator;

a SEG waveform table connected with the SEG waveform generator; and a COM waveform table connected with the COM waveform generator; wherein:

the memory module for each segment comprises an old Data corresponding to a current state of the segment of the display, a new Data corresponding to a new state to be driven for the segment in a display update period, and a COM_Option memory corresponding to an option state;

based on the current state and the new state, the SEG 4-to-1 multiplexor is configured to select one waveform from output of the SEG waveform generator and output the selected waveform to the 2-to-1 multiplexor; and based on the option state, the 2-to-1 multiplexor is configured to select a waveform from output of the COM waveform generator and output of the SEG 4-to-1 multiplexor and output the selected waveform to the SEG cell.

2. The apparatus of claim 1, wherein the timing controller is configured to output timing signals during display update to the SEG waveform generator, the COM waveform generator, and the memory module.

3. The apparatus of claim 1, wherein the SEG waveform table and the COM waveform table are respectively configured to store and output static parameters of SEG waveforms and COM waveforms.

4. The apparatus of claim 1, wherein the SEG waveform generator is configured to generate and output four SEG waveforms in digital domain according to waveform parameters and timing signals.

5. The apparatus of claim 1, wherein the COM waveform generator is configured to generate and output COM waveforms in digital domain.

6. The apparatus of claim 1, wherein the SEG cells and the COM cell are respectively configured to output analog SEG and COM driving signals to drive the display.

7. A method for driving an e-paper display, the display comprising a plurality of segments, the method comprising:

starting with the display with an image of all segments of known greyscale levels;

selecting greyscale levels from the image for an iteration of driving the display;

identifying segments of the selected greyscale levels;

setting a memory module for all segments;

setting a SEG waveform table and a COM waveform table to define driving waveforms;

driving a display panel with the defined driving waveforms;

displaying image updated with the identified segments in the selected greyscale levels; and starting another iteration if there are segments that need to be driven to alter greyscale level;

wherein:

the SEG waveform table is connected with a SEG waveform generator, which is further connected with a SEG 4-to-1 multiplexor for each identified segment;

the COM waveform table is connected with a COM waveform generator, which is further connected with 2-to-1 multiplexor for each identified segment, the 2-to-1 multiplexor being connected with the SEG 4-to-1 multiplexor for each identified segment;

the memory module for each identified segment comprises an old Data corresponding to a current state of the segment of the display, a new Data corresponding to a new state to be driven for the segment in a display update period, and a COM_Option memory corresponding to an option state;

based on the current state and the new state, the SEG 4-to-1 multiplexor is configured to select one waveform from output of the SEG waveform generator and output the selected waveform to the 2-to-1 multiplexor;

based on the option state, the 2-to-1 multiplexor is configured to select a waveform from output of the COM waveform generator and output of the SEG 4-to-1 multiplexor and output the selected waveform; and the method further comprises setting the option state so that the 2-to-1 multiplexor is configured to select output of the SEG 4-to-1 multiplexor for the identified segments; and setting the option state so that the 2-to-1 multiplexor is configured to select output of the COM waveform generator for segments other than the identified segments.

8. The method of claim 7 further comprising outputting timing signals during display update to the SEG waveform generator, the COM waveform generator, and the memory module with a timing controller.

9. The method of claim 7, wherein the SEG waveform table and the COM waveform table are respectively configured to store and output static parameters of SEG waveforms and COM waveforms.

10. The method of claim 7, wherein the SEG waveform generator is configured to generate and output four SEG waveforms in digital domain according to waveform parameters and timing signals.

11. The method of claim 7, wherein the COM waveform generator is configured to generate and output COM waveforms in digital domain.

12. The method of claim 7 further comprising outputting analog SEG and COM driving signals to drive the display with a SEG cell for each segment and a COM cell respectively.

13. An apparatus for driving an e-paper display, the display comprising a plurality of segments, the apparatus comprising:

a memory module for each segment;

a SEG 4-to-1 multiplexor connected with the memory module for each segment;

a 2-to-1 multiplexor connected with the SEG 4-to-1 multiplexor for each segment;

a SEG waveform generator connected with the SEG 4-to-1 multiplexor;

a COM waveform generator connected with the 2-to-1 multiplexor;

a SEG waveform table connected with the SEG waveform generator; and a COM waveform table connected with the COM waveform generator; wherein:

the memory module for each segment comprises an old Data corresponding to a current state of the segment of the display, a new Data corresponding to a new state to be driven for the segment in a display update period, and a COM_Option memory corresponding to an option state;

based on the current state and the new state, the SEG 4-to-1 multiplexor is configured to select one waveform from output of the SEG waveform generator and output the selected waveform to the 2-to-1 multiplexor; and based on the option state, the 2-to-1 multiplexor is configured to select a waveform from output of the COM waveform generator and output of the SEG 4-to-1 multiplexor and output the selected waveform to the SEG cell.

14. The apparatus of claim 13 further comprising a timing controller configured to output timing signals during display update to the SEG waveform generator, the COM waveform generator, and the memory module.

15. The apparatus of claim 13, wherein the SEG waveform table and the COM waveform table are respectively configured to store and output static parameters of SEG waveforms and COM waveforms.

16. The apparatus of claim 13, wherein the SEG waveform generator is configured to generate and output four SEG waveforms in digital domain according to waveform parameters and timing signals.

17. The apparatus of claim 13, wherein the COM waveform generator is configured to generate and output COM waveforms in digital domain.

18. The apparatus of claim 13 further comprising a SEG cell connected with the 2-to-1 multiplexor for each segment.

19. The apparatus of claim 18 further comprising a COM cell connected with the COM waveform generator.

20. The apparatus of claim 19, wherein the SEG cells and the COM cell are respectively configured to output analog SEG and COM driving signals to drive the display.

* * * * *